US007896785B1

(12) United States Patent
Marcus

(10) Patent No.: US 7,896,785 B1
(45) Date of Patent: Mar. 1, 2011

(54) PUMP/EXERCISE SYSTEM

(76) Inventor: Robert F. Marcus, St. Petersburg, FL (US)

( * ) Notice: Subject to any disclaimer, the term of this patent is extended or adjusted under 35 U.S.C. 154(b) by 0 days.

(21) Appl. No.: 12/583,620

(22) Filed: Aug. 24, 2009

(51) Int. Cl.
*A63B 21/008* (2006.01)
*A63B 21/06* (2006.01)

(52) U.S. Cl. ..... 482/112; 482/93; 482/111

(58) Field of Classification Search ..... 482/58, 482/59, 73, 93, 106, 111–113, 126, 128
See application file for complete search history.

(56) References Cited

U.S. PATENT DOCUMENTS 3,359,802 A * 12/1967 Sollenberger ..... 482/112
3,784,195 A * 1/1974 Johnson ..... 482/123
4,951,941 A * 8/1990 Resk ..... 482/112
5,069,448 A * 12/1991 Shyu ..... 482/112
5,071,119 A * 12/1991 Johnson ..... 482/112
5,154,685 A * 10/1992 Chen ..... 482/126
5,501,646 A * 3/1996 Miller ..... 482/11
6,402,667 B1 * 6/2002 Dahn ..... 482/121
6,468,190 B1 * 10/2002 Fazio et al. ..... 482/112
7,163,495 B2 * 1/2007 Fazio et al. ..... 482/112
7,569,003 B1 * 8/2009 Huffman ..... 482/112
2007/0238588 A1 * 10/2007 Butler ..... 482/70

* cited by examiner

*Primary Examiner* — Allana Lewin

(57) ABSTRACT

A pump assembly includes a cylinder, a piston, a rod, upper and lower end caps, all sharing a common central axis. The cylinder has internal and external surfaces. The piston has a cylindrical exterior surface with an annular groove. An O-ring within the groove is in sliding contact with the internal surface of the cylinder. The rod has a lower end coupled to the piston and an upper end above the cylinder. The lower end cap is over the bottom of the cylinder and the upper end cap is over the top of the cylinder. An aperture in one of the end caps allows air to escape as the piston moves. A handle has a cross piece with a central section attached to the rod. The handle has grips slidably received over end sections. A rigid base has an upper face having a central section. A pivot pin joins the base to the lower end cap for allowing the cylinder to oscillate during use of the system.

4 Claims, 3 Drawing Sheets

FIG 3
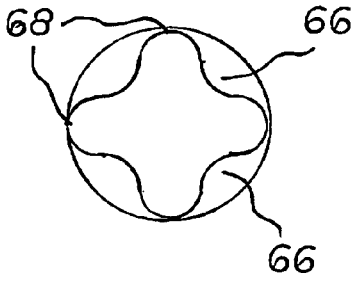
FIG 4
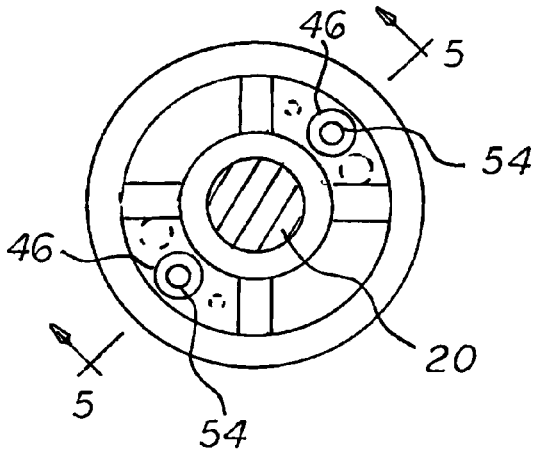
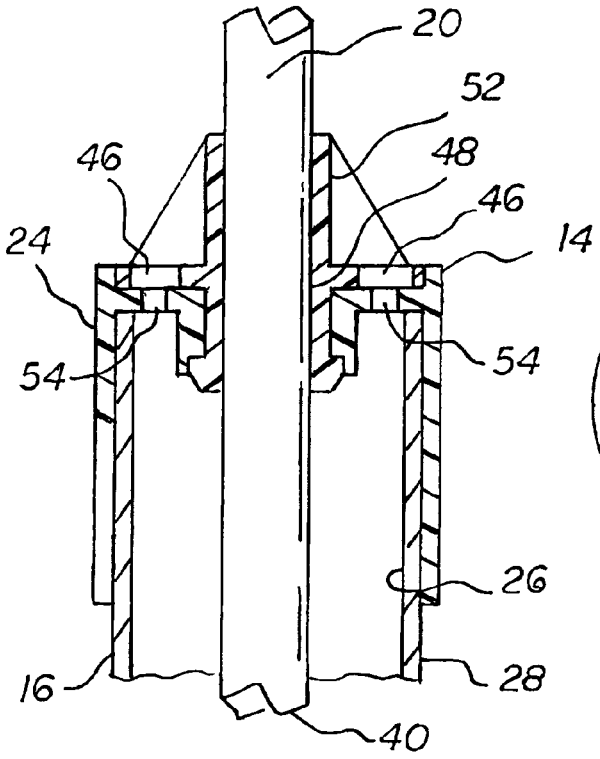
FIG 5
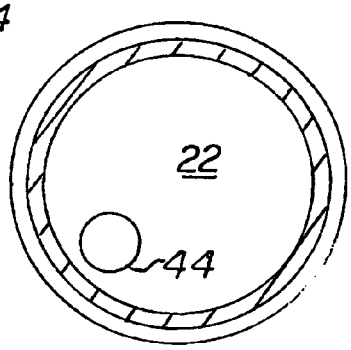
FIG 6

PUMP/EXERCISE SYSTEM

BACKGROUND OF THE INVENTION

1. Field of the Invention

The present invention relates to a pump/exercise system and more particularly pertains to facilitating a plurality of cardiovascular and other exercises in a safe, efficient, entertaining and economical manner.

2. Description of the Prior Art

The use of exercise systems of known designs and configurations is known in the prior art. More specifically, exercise systems of known designs and configurations previously devised and utilized for the purpose of facilitating cardiovascular and other exercises are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe pump/exercise system that allows facilitating a plurality of cardiovascular and other exercises in a safe, efficient, entertaining and economical manner.

In this respect, the pump/exercise system according to the present invention substantially departs from the conventional concepts and designs of the prior art, and in doing so provides an apparatus primarily developed for the purpose of facilitating a plurality of cardiovascular and other exercises in a safe, efficient, entertaining and economical manner.

Therefore, it can be appreciated that there exists a continuing need for a new and improved pump/exercise system which can be used for facilitating a plurality of cardiovascular and other exercises in a safe, efficient, entertaining and economical manner. In this regard, the present invention substantially fulfills this need.

SUMMARY OF THE INVENTION

In view of the foregoing disadvantages inherent in the known types of exercise systems of known designs and configurations now present in the prior art, the present invention provides an improved pump/exercise system. As such, the general purpose of the present invention, which will be described subsequently in greater detail, is to provide a new and improved pump/exercise system and method which has all the advantages of the prior art and none of the disadvantages.

To attain this, the present invention essentially comprises a cylinder with an internal cylindrical surface, an external cylindrical surface, a top and a bottom. The length of the cylinder is 24 inches, plus or minus 10 percent. The interior diameter of the cylinder is 3.5 inches, plus or minus 10 percent. The exterior diameter of the cylinder is 4 inches, plus or minus 10 percent. The cylinder is fabricated of a rigid metallic material selected from the class of rigid metallic materials including aluminum and stainless steel.

The piston has a cylindrical exterior surface with an annular groove. An elastomeric O-ring is located within the groove and in sliding contact with the internal cylindrical surface of the cylinder.

The rod has a lower end coupled to the piston and an upper end above the cylinder. The rod is adapted to be axially reciprocated by a user to move the piston between adjacent to the top and adjacent to the bottom of the cylinder.

The end caps include a lower end cap over the bottom of the cylinder. A lower aperture is provided in the lower end cap for the escape of air as the piston moves toward the bottom of the cylinder.

The end caps also include an upper end cap over the top of the cylinder. Upper apertures are provided in the upper end cap for the escape of air as the piston moves toward the top of the cylinder. The upper end cap has a central bore for the sliding receipt of the rod. The upper end cap is rotatable about the central axis. An annular bearing is between the rod and the upper end cap. Fixed exhaust ports are adapted to be aligned with the upper apertures for varying the effective size of the upper apertures to thereby vary the force needed by the user to move the piston.

Next provided is a handle. The handle has a cross piece. The cross piece has a center section attached to the upper end of the rod. The cross piece has end sections with axial recesses and bearing surfaces. Elastomeric grips are slidably received over the end sections of the cross piece. The recesses reduce the frictional relationship between the grip and the handle for facilitating the oscillation of the grips about the end sections during use.

A rigid base is next provided. The rigid base has an upper face and a lower face. The lower face is positionable upon a floor. The upper face has a central section with a pivot pin joining the base to the lower end cap for allowing the cylinder to oscillate during use of the system. The upper face has laterally spaced foot rests for receiving the feet of the user to secure the system during use. The foot rests have straps for securing the feet of the user to the system.

Lastly, cylindrical weights are provided. The cylindrical weights have axial apertures. The cylindrical weights are removably positionable upon the end sections of the handle between the central section of the handle and the grip.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pump/exercise system which has all of the advantages of the prior art exercise systems of known designs and configurations and none of the disadvantages.

It is another object of the present invention to provide a new and improved pump/exercise system which may be easily and efficiently manufactured and marketed.

It is further object of the present invention to provide a new and improved pump/exercise system which is of durable and reliable constructions.

An even further object of the present invention is to provide a new and improved pump/exercise system which is susceptible of a low cost of manufacture with regard to both materials and labor, and which accordingly is then susceptible of low prices of sale to the consuming public, thereby making such pump/exercise system economically available to the buying public.

Even still another object of the present invention is to provide a pump/exercise system for facilitating a plurality of cardiovascular and other exercises in a safe, efficient, entertaining and economical manner.

Lastly, it is an object of the present invention to provide a new and improved A pump assembly includes a cylinder, a piston, a rod, upper and lower end caps, all sharing a common central axis. The cylinder has internal and external surfaces. The piston has a cylindrical exterior surface with an annular groove. An O-ring within the groove is in sliding contact with the internal surface of the cylinder. The rod has a lower end coupled to the piston and an upper end above the cylinder. The lower end cap is over the bottom of the cylinder and the upper end cap is over the top of the cylinder. An aperture in one of the end caps allows air to escape as the piston moves. A handle has a cross piece with a central section attached to the rod. The handle has grips, slidably received over end sections. A rigid base has an upper face having a central section. A pivot pin joins the base to the lower end cap for allowing the cylinder to oscillate during use of the system.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an end elevational view taken along line 3-3 of FIG. 2.

FIG. 4 is cross-sectional view taken along line 4-4 of FIG. 1.

FIG. 5 is a cross-sectional view taken thru the central upper section of the cylinder.

FIG. 6 is a cross-sectional view taken along line 6-6 of FIG. 1.

The same reference numerals refer to the same parts throughout the various Figures.

DESCRIPTION OF THE PREFERRED EMBODIMENT

Figure 1:
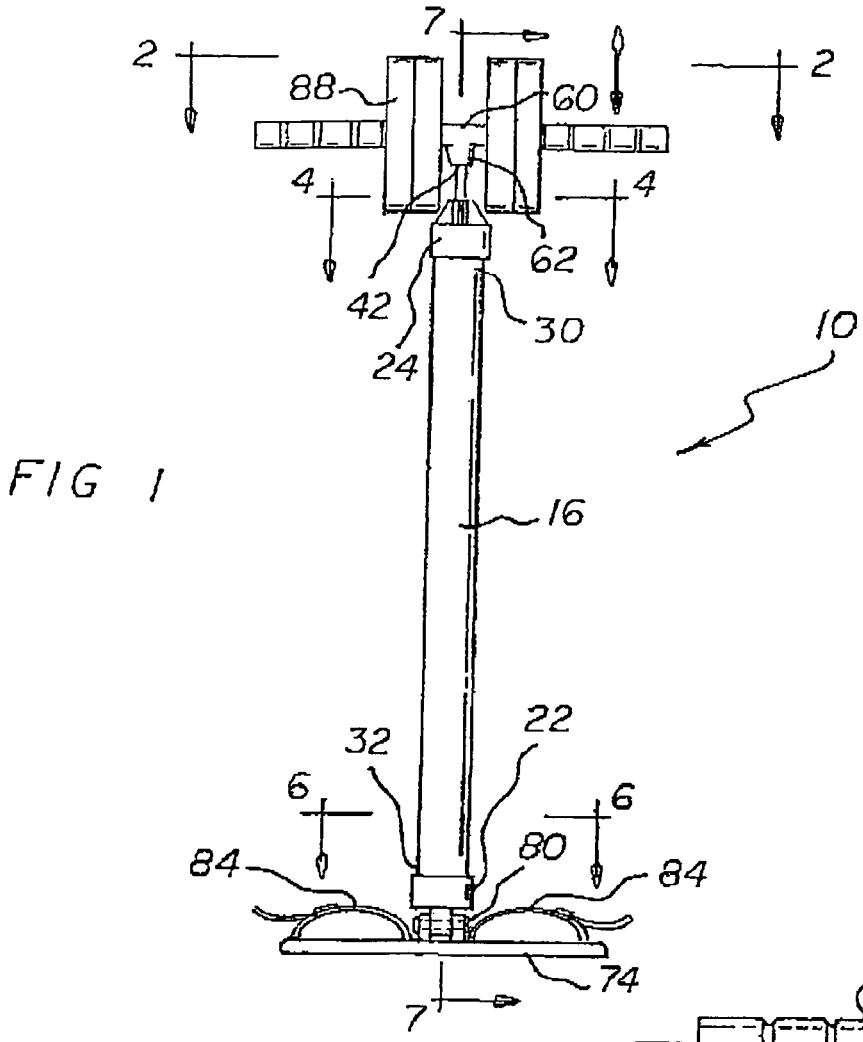
FIG. 1 is a front elevational view of a pump/exercise system constructed in accordance with the principles of the present invention.
Figure 2:
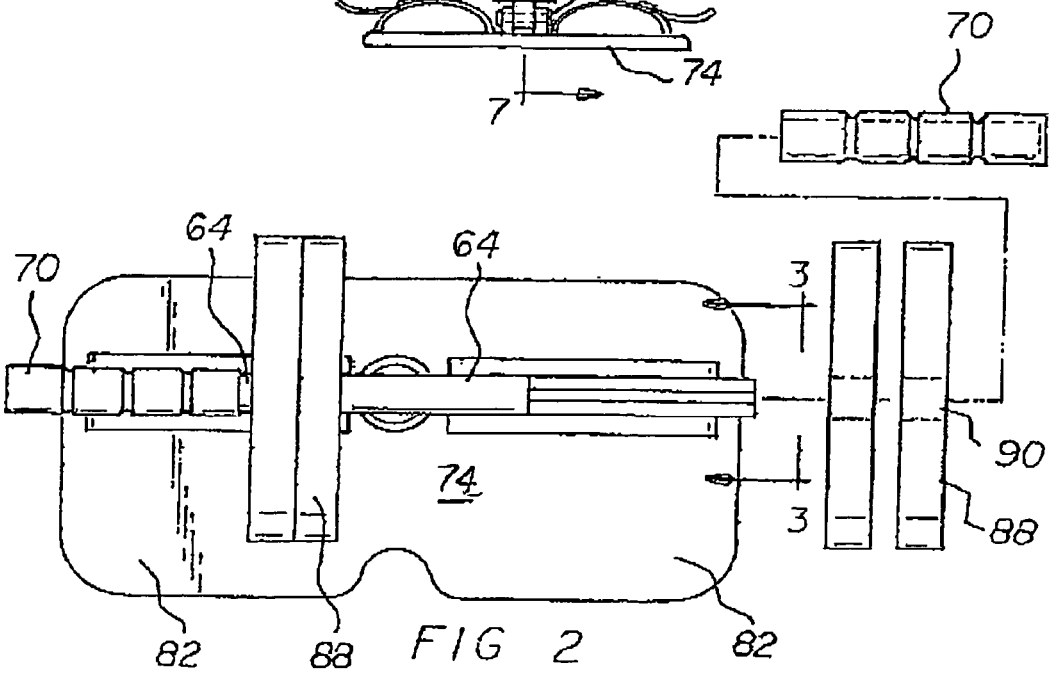
FIG. 2 is a plan view of the system taken along line 2-2 of FIG. 1.
Figure 7:
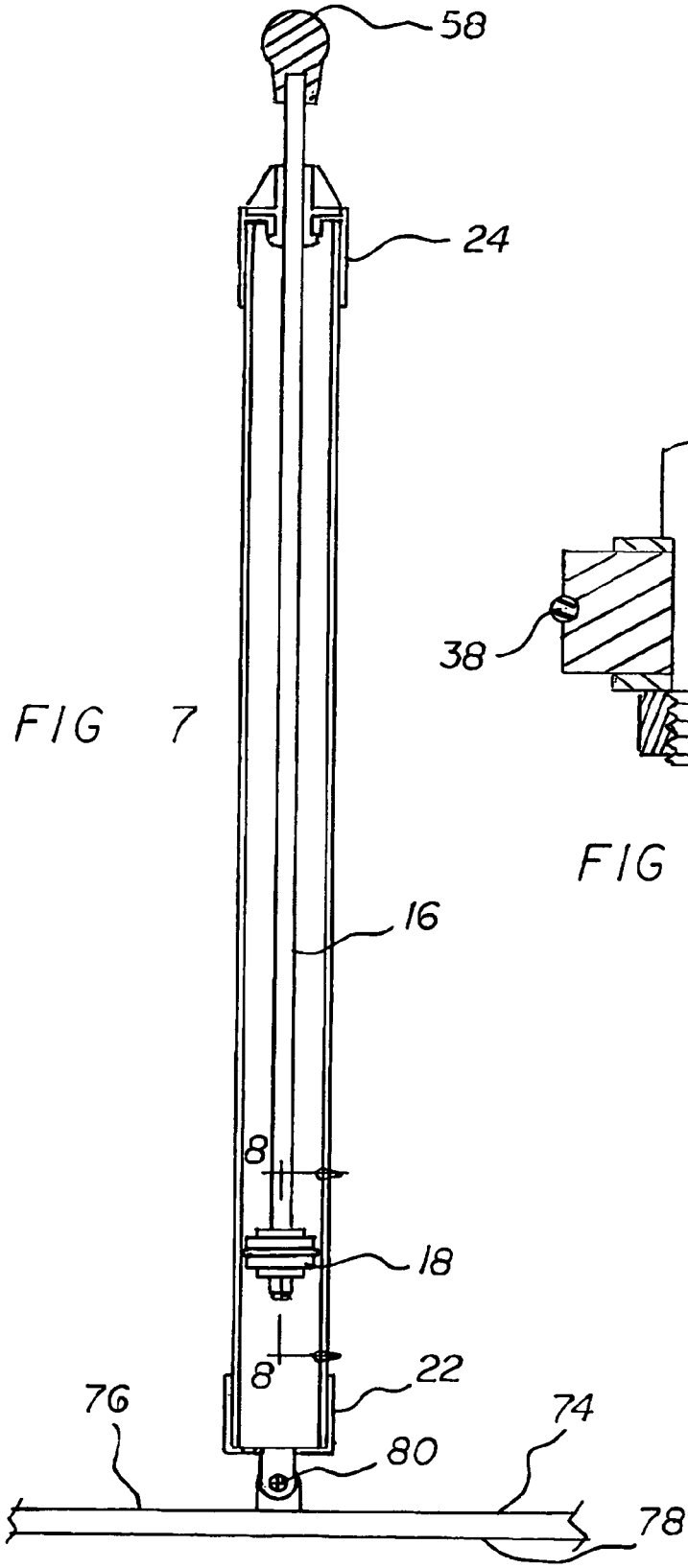
FIG. 7 is a cross-sectional view taken along line 7-7 of FIG. 1.
Figure 8:
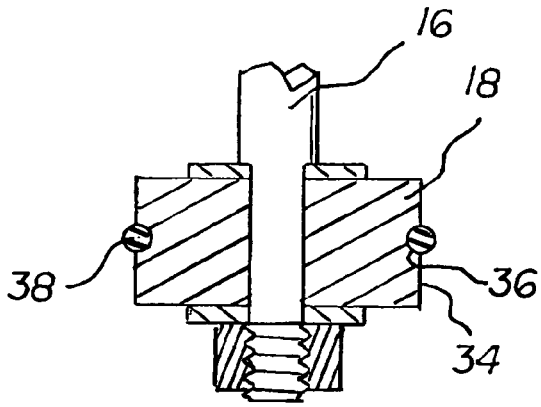
FIG. 8 is a cross-sectional view taken along line 8-8 of FIG. 7.

With reference now to the drawings, and in particular to FIG. 1 thereof, the preferred embodiment of the new and improved pump/exercise system embodying the principles and concepts of the present invention and generally designated by the reference numeral 10 will be described.

The present invention, the pump/exercise system 10 is comprised of a plurality of components. Such components in their broadest context include a pump assembly, end caps, a handle and a rigid base. Such components are individually configured and correlated with respect to each other so as to attain the desired objective.

The pump/exercise system 10 of the present invention is for facilitating a plurality of cardiovascular and other exercises. The facilitating is done in a safe, efficient, entertaining and economical manner. First provided is a pump assembly 14. The pump assembly includes a cylinder 16, a piston 18, a rod 20, and end caps 22, 24. The cylinder, piston, rod, and end caps share a common vertical central axis.

The cylinder has an internal cylindrical surface 26, an external cylindrical surface 28, a top 30 and a bottom 32. The length of the cylinder is 24 inches, plus or minus 10 percent. The interior diameter of the cylinder is 3.5 inches, plus or minus 10 percent. The exterior diameter of the cylinder is 4 inches, plus or minus 10 percent. The cylinder is fabricated of a rigid metallic material selected from the class of rigid metallic materials including aluminum and stainless steel.

The piston has a cylindrical exterior surface 34 with an annular groove 36. An elastomeric O-ring 38 is located within the groove and in sliding contact with the internal cylindrical surface of the cylinder.

The rod has a lower end 40 coupled to the piston and an upper end 42 above the cylinder. The rod is adapted to be axially reciprocated by a user to move the piston between adjacent to the top and adjacent to the bottom of the cylinder.

The end caps include a lower end cap 22 over the bottom of the cylinder. A lower aperture 44 is provided in the lower end cap for the escape of air as the piston moves toward the bottom of the cylinder.

The end caps also include an upper end cap 24 over the top of the cylinder. Upper apertures 46 are provided in the upper end cap for the escape of air as the piston moves toward the top of the cylinder. The upper end cap has a central bore 48 for the sliding receipt of the rod. The upper end cap is rotatable about the central axis. An annular bearing 52 is between the rod and the upper end cap. Fixed exhaust ports 54 are adapted to be aligned with the upper apertures for varying the effective size of the upper apertures to thereby vary the force needed by the user to move the piston.

Next provided is a handle 58. The handle has a cross piece 60. The cross piece has a center section 62 attached to the upper end of the rod. The cross piece has end sections 64 with axial recesses 66 and bearing surfaces 68. Elastomeric grips 70 are slidably received over the end sections of the cross piece. The recesses reduce the frictional relationship between the grip and the handle for facilitating the oscillation of the grips about the end sections during use.

A rigid base 74 is next provided. The rigid base has an upper face 76 and a lower face 78. The lower face is positionable upon a floor. The upper face has a central section with a pivot pin 80 joining the base to the lower end cap for allowing the cylinder to oscillate during use of the system. The upper face has laterally spaced foot rests 82 for receiving the feet of the user to secure the system during use. The foot rests have straps 84 for securing the feet of the user to the system.

Lastly, cylindrical weights 88 are provided. The cylindrical weights have axial apertures 90. The cylindrical weights are removably positionable upon the end sections of the handle between the central section of the handle and the grip.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pump/exercise system comprising:

a pump assembly including a cylinder, a piston, a rod, and end caps, all sharing a common central axis, the cylinder having an interior with an internal surface and an exterior with an external surface, the piston having a cylindrical exterior surface with an annular groove and an O-ring within the groove and in sliding contact with the internal surface of the cylinder, the rod having a lower end coupled to the piston and an upper end above the cylinder;

the end caps including a lower end cap over the bottom of the cylinder and an upper end cap over the top of the cylinder with an aperture in one of the caps for the escape of air as the piston moves;

a handle with a cross piece with a central section attached to the rod, the handle having end sections, grips slidably received over the end sections;

a rigid base having upper and lower faces, the upper face having a central section with a pivot pin joining the base to the lower end cap for allowing the cylinder to oscillate during use of the system; and laterally spaced foot rests on the base for receiving feet of a user to secure the system during use, the foot rests having straps for securing the feet of the user to the system; and cylindrical weights with axial apertures removably positionable upon the end sections of the handle between the central section of the handle and the grip.

2. The system as set forth in claim 1 wherein:

the upper end cap is rotatable about the central axis and has a central bore for the sliding receipt of the rod; and the system further includes an annular bearing between the rod and the upper end cap with fixed exhaust ports.

3. A pump/exercise system for facilitating a plurality of Cardiovascular and other exercises, the system comprising, in combination:

a pump assembly including a cylinder, a piston, a rod, and end caps, the cylinder, piston, rod, and end caps sharing a common vertical central axis, the cylinder having an internal cylindrical surface and an external cylindrical surface, the cylinder having a top and a bottom, the cylinder having a length of 24 inches, plus or minus 10 percent, and an interior diameter of 3.5 inches, plus or minus 10 percent, and an exterior diameter of 4 inches, plus or minus 10 percent, the cylinder being fabricated of a rigid metallic material selected from the class of rigid metallic materials including aluminum and stainless steel, the piston having a cylindrical exterior surface with an annular groove and an elastomeric O-ring, the O-ring being located within the groove and in sliding contact with the internal cylindrical surface of the cylinder, the rod having a lower end coupled to the piston and an upper end above the cylinder, the rod adapted to be axially reciprocated by a user to move the piston between adjacent to the top and adjacent to the bottom of the cylinder;

the end caps including a lower end cap over the bottom of the cylinder with a lower aperture in the lower end cap for the escape of air as the piston moves toward the bottom of the cylinder, the end caps including an upper end cap over the top of the cylinder with upper apertures in the upper end cap for the escape of air as the piston moves toward the top of the cylinder, the upper end cap having a central bore for the sliding receipt of the rod, the upper end cap being rotatable about the central axis, an annular bearing between the rod and the upper end cap with fixed exhaust ports adapted to be aligned with the upper apertures for varying the effective size of the upper apertures to thereby vary the force needed by the user to move the piston;

a handle with a cross piece, the cross piece having a center section attached to the upper end of the rod, the cross piece having end sections with axial recesses and bearing surfaces, elastomeric grips slidably received over the end sections of the cross piece, the recesses reducing the frictional relationship between the grip and the handle for facilitating the oscillation of the grips about the end sections during use;

a rigid base having an upper face and a lower face, the lower face positionable upon a floor, the upper face having a central section with a pivot pin joining the base to the lower end cap for allowing the cylinder to oscillate during use of the system, the upper face having laterally spaced foot rests for receiving the feet of the user to secure the system during use, the foot rests having straps for securing the feet of the user to the system; and cylindrical weights with axial apertures removably positionable upon the end sections of the handle between the central section of the handle and the grip.

4. A pump/exercise system for facilitating a plurality of cardiovascular and other exercises, the system comprising, in combination:

a pump assembly including a cylinder, a piston, a rod, and end caps, the cylinder, piston, rod, and end caps sharing a common vertical central axis, the cylinder having an internal cylindrical surface and an external cylindrical surface, the cylinder having a top and a bottom, the cylinder having a length of 24 inches, plus or minus 10 percent, and an interior diameter of 3.5 inches, plus or minus 10 percent, and an exterior diameter of 4 inches, plus or minus 10 percent, the cylinder being fabricated of a rigid metallic material selected from the class of rigid metallic materials including aluminum and stainless steel, the piston having a cylindrical exterior surface with an annular groove and an elastomeric O-ring, the O-ring being located within the groove and in sliding contact with the internal cylindrical surface of the cylinder, the rod having a lower end coupled to the piston and an upper end above the cylinder, the rod adapted to be axially reciprocated by a user to move the piston between adjacent to the top and adjacent to the bottom of the cylinder;

the end caps including a lower end cap over the bottom of the cylinder with at least one lower aperture in the lower end cap for the movement of air between the cylinder and the atmosphere as the piston moves, the end caps including an upper end cap over the top of the cylinder with at least one upper aperture in the upper end cap for the movement of air between the cylinder and the atmosphere, the upper end cap having a central bore for the sliding receipt of the rod, the upper end cap being rotatable about the central axis, an annular bearing between the rod and the upper end cap with fixed exhaust ports adapted to be aligned with the upper apertures for varying the effective size of the upper apertures to thereby vary the force needed by the user to move the piston;

a handle with a cross piece, the cross piece having a center section attached to the upper end of the rod, the cross piece having end sections with axial recesses and bearing surfaces, elastomeric grips slidably received over the end sections of the cross piece, the recesses reducing the frictional relationship between the grip and the handle for facilitating the oscillation of the grips about the end sections during use; and a rigid base having an upper face and a lower face, the lower face positionable upon a floor, the upper face having a central section with a pivot pin joining the base to the lower end cap for allowing the cylinder to oscillate during use of the system, the upper face having laterally spaced foot rests for receiving the feet of the user to secure the system during use, the foot rests having straps for securing the feet of the user to the system.

* * * * *